US005282769A

United States Patent [19]

Suzukawa

[11] Patent Number: 5,282,769

[45] Date of Patent: Feb. 1, 1994

[54] COIN SORTING DEVICE WITH AN ESCALATOR

[75] Inventor: Yorio Suzukawa, Tokyo, Japan

[73] Assignee: Asahi Seiko Kabushiki Kaisha, Tokyo, Japan

[21] Appl. No.: 970,680

[22] Filed: Nov. 4, 1992

[51] Int. Cl.[5] ..... G07D 1/00

[52] U.S. Cl. ..... 453/49; 453/57

[58] Field of Search ..... 453/18, 33, 39, 40, 453/49, 57, 34, 35

[56] References Cited

U.S. PATENT DOCUMENTS

| | | | |
|---|---|---|---|
| 3,902,511 | 9/1975 | Jacobs | 453/34 X |
| 4,592,377 | 6/1986 | Paulsen et al. | 453/33 |
| 4,752,274 | 6/1988 | Abe | 453/57 X |
| 4,978,322 | 12/1990 | Paulsen . | |
| 5,046,989 | 9/1991 | Dass | 453/33 X |
| 5,170,874 | 12/1992 | Abe | 453/57 X |
| 5,181,881 | 1/1993 | Abe | 453/57 |

FOREIGN PATENT DOCUMENTS

| | | | |
|---|---|---|---|
| 0204405 | 12/1986 | European Pat. Off. | 453/49 |
| 0311320 | 4/1989 | European Pat. Off. | 453/40 |
| 0469886 | 2/1992 | European Pat. Off. | 453/49 |
| 0304595 | 12/1989 | Japan | 453/57 |
| 2185341 | 7/1987 | United Kingdom | 453/40 |
| 2251114 | 6/1992 | United Kingdom . | |
| 9002389 | 3/1990 | World Int. Prop. O. . | |

*Primary Examiner*—Michael S. Huppert
*Assistant Examiner*—Scott L. Lowe
*Attorney, Agent, or Firm*—Hopgood, Calimafde, Kalil, Blaustein & Judlowe

[57] ABSTRACT

Coins stored in a hopper (1) are delivered one by one towards an outlet of a hollow cylindrical case (3) on a base plate (2) by coin feeding arms (9) of a coin feeding disc (4) having coin receiving holes (8). The coin feeding disc (4) is rotated in the hollow cylindrical case (3). The coin is further delivered out of the hollow cylindrical case (3) by coin feeding wings (12) of a scraper (13) rotated on the base plate (2) outside of the hollow cylindrical case (3). An upright coin carrier duct (17) is disposed, with an opening at the lower end thereof, on the inclined base plate (2). A coin guide (21) is disposed along a coin transporting path (15) where a coin is delivered by the coin feeding wings (12) of the scraper (13). The coin engaged with the coin guide (21) is pushed towards the lower end port of the coin carrier duct (17) by a convex portion formed at the leading side of each of the coin feeding wings (12).

5 Claims, 3 Drawing Sheets

COIN SORTING DEVICE WITH AN ESCALATOR

BACKGROUND OF THE INVENTION

This invention relates to a coin sorting device for sorting a coin such as a money coin or a token in a coin exchanger, a vending machine or a coin operated gaming machine and, more particularly, this invention relates to a coin sorting device with an escalator. Such a coin sorting device comprises a hopper where a supply of coins are stored in bulk. The coin is delivered one by one from the hopper to a coin receiving hole opened at an upper portion of the device by means of rotation of a rotary disc through an upright coin carrier duct, which in general is called as an escalator.

Conventionally, such a coin sorting device with an escalator is well known as disclosed in, for example, U.S. Pat. No. 4,592,377.

However, in a conventional well-known coin sorting device with the escalator, an outlet chute projects from one side of the hopper is connected to the lower end of an upright coin carrier duct. Accordingly, it requires some means for supporting the coin carrier duct in an upright state, resulting in a device of an enlarged dimension. The enlarged device disposed in, for example, a vertical coin exchanger has a disadvantage that it makes the coin exchanger wide and deep.

The present invention is directed to provide a small coin sorting device with an escalator. Thus, a primary object of the present invention is to provide a small coin sorting device with an escalator substantially accompanying with no increase of the width and the depth of a small coin sorting device by means of improving the latter disclosed in, for example, Japanese Examined Patent Publication No. 36040/1988.

SUMMARY OF THE INVENTION

According to the present invention, a coin sorting device comprises a base plate having an upper end portion where a coin carrier duct for delivering a coin in the upward direction is substantially vertically arranged; scraper means for feeding the coin towards said upper end portion, said scrapter means comprising a rotational body rotatably supported on said base plate and coin feeding wings or fingers extending radially outwardly from said rotational body, each of said coin feeding wings or fingers being adopted for use in forcing said coin to said upper end portion by means of rotation of said rotational body; and coin guiding means arranged at said upper end portion for guiding said coin forced to said upper end portion by said coin feeding wings or fingers to said coin carrier duct.

According to the present invention, the coin feeding wing has a convex being expanded towards rotational direction of said rotational body.

The coin guiding means is disposed at said upper end portion and comprises a pair of shaft portions opposing to and being apart from each other at a distance substantially corresponding to a diameter of said coin, and roller portions rotatably disposed to each of said pair of shaft portions, said roller portions are for use in preventing the coin from rising up.

Each of said roller portions has a taper surface for forcing said coin against said upper end portion.

The pair of shaft portions are disposed at said upper end portion with a distance therebetween being variable.

A coin sorting device according to the present invention further comprises a rotary disc opposing to said base plate at a distance corresponding to the thickness of the coin; a guide hole opened on said rotary disc for guiding the coin onto said base plate; and a feeding arm positioned between said base plate and said rotary disc for feeding the coin in said guide hole towards said scraper according to said rotary disc, said scraper receives the coin transferred from said feeding arm.

A coin sorting device according to the present invention comprises, as shown in FIGS. 1 and 2, a hopper 1 for storing a supply of coins in bulk, a hollow cylindrical case 3 disposed at the lower end of the hopper and secured on an inclined base plate 2, a coin feeding disc 4 disposed on the inclined base plate so as to be rotated in the hollow cylindrical case, and driving devices 5, 6 and 7 for use in rotating the coin feeding disc. A plurality of coin receiving holes 8 are penetrating through the coin feeding disc, apart from each other along the circumference of the disc. Each of the coin receiving holes 8 has a dimension for receiving a coin to be fed to the coin feeding disc. Each of coin feeding arms 9 is projected from the back surface of the coin feeding disc at a position between the adjacent coin receiving holes, such that a coin received in the coin receiving hole is delivered onto the base plate by means of the coin feeding arm accompanying with the rotation of the coin feeding disc. An outlet port 10 is formed at a lower end portion of the peripheral surface of the hollow cylindrical case at one side thereof. An outlet guiding member 11 is disposed on the base plate at the downstream of the outlet port for guiding the coin pushed on the base plate to the outlet port. The coin sorting device according to the present invention further comprises a scraper 13 which is rotated in synchronism with the coin feeding disc 4. Feeding wings or fingers 12 of the scraper 13 is positioned beneath the coin feeding disc 4 and between the adjacent coin receiving holes 8. The coin is delivered due to a convex portion of the feeding wing 12 of the scraper 13. The convex portion is formed on the leading side to the rotational direction. A coin carrier duct 17 is uprightly secured at the extended portion of the coin transporting path 15. The coin carrier duct 17 comprises a lower end port 16. The coin is transferred towards the lower end port 16 of the coin carrier duct 17 by means of the guide rollers 18 and 19 and the convex portion 12*a* of the feeding wing 12 of the scraper 13.

BRIEF DESCRIPTION OF THE DRAWING

Other objects and advantageous of the present invention will become apparent from the following description taken together with the drawings in which.

DETAILED DESCRIPTION OF THE PREFERRED EMBODIMENT

Figure 1:
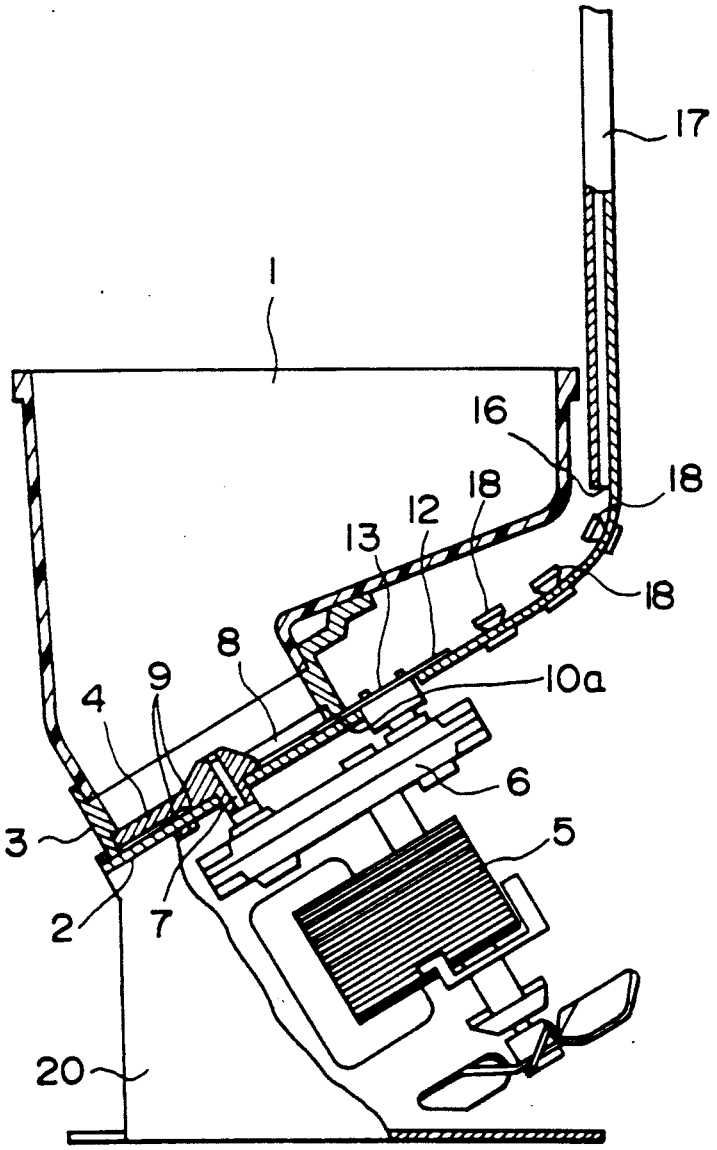
FIG. 1 is a schematical side view of a coin sorting device with an escalator according to the present invention, where a part of which is illustrated as a cross section.

FIG. 1 shows an embodiment of the present invention. In FIG. 1, a reference numeral 1 represents a hopper where a supply of coins are stored in bulk. The lower end of the hopper 1 is fastened to the upper end of a hollow cylindrical case 3. The hollow cylindrical case 3 is removably attached to an inclined base plate 2 in a well-known manner. The inclined base plate 2 is secured on a platform 20.

In the hollow cylindrical case 3, a coin feeding disc 4 is rotatably attached to the inclined base plate 2. A disc boss is secured to a rotary shaft 7 driven by a drive motor 5 through a transmission 6. Thus, the coin feeding disc 4 is rotated in synchronism with the rotary shaft 7 in the hollow cylindrical case 3.

In accordance with the above mentioned construction of the present invention, each coin delivered from the hopper 1 to the hollow cylindrical case 3 is further transferred to one of coin receiving holes 8. As will later be described more detail, the coin receiving holes 8 are formed on the coin feeding disc 4 rotated in the hollow cylindrical case 3. The coin received in the coin receiving hole 8 is transferred onto the base plate 2 through the hollow cylindrical case 3 by means of a coin feeding arm 9 projected from the back surface of the coin feeding disc 4.

A plurality of coin receiving holes 8 are formed on the coin feeding disc 4 with being apart from each other along the circumference of the disc. Each of the coin receiving holes 8 has an acceptable size for the coin to be thrown and penetrates or passes through the coin feeding disc 4. The coin feeding arm 9 is projected or extends from the back surface of the coin feeding disc 4 at a position between the adjacent coin receiving holes 8, 8. The coin feeding arm 9 extends by an amount suitable for holding one coin and is extended to a peripheral of a circle formed by connecting approximately center of each coin receiving hole 8. Thus, the coin received in the coin receiving hole 8 is transferred on the base plate 2 through the hollow cylindrical case 3 by means of the coin feeding arm 9 accompanying with the rotation of the coin feeding disc 4.

The coin sorting device according to the present invention further comprises a scraper 13 which is rotated in synchronism with the coin feeding disc 4. When the coin feeding arm 9 is rotated, a feeding wing or finger 12 of the scraper 13 is interposed between the back surface of the coin feeding disc 4 and the base plate 2 at a position between the adjacent coin receiving holes 8 by moving from the external position of the hollow cylindrical case 3 through an opening portion 10*a* formed at the lower portion of the peripheral wall of the hollow cylindrical case 3. In this event, the feeding wing or finger 12 of the scraper 13 is positioned beneath the coin feeding disc 4 and between the adjacent coin receiving holes 8. Therefore, the scraper 13 can be smoothly rotated in synchronism with the coin feeding disc 4 without being interfered by the coin in the coin receiving hole 8.

Further rotation of the coin feeding disc 4 makes the feeding wing or finger 12 of the scraper 13 engage with a tailing edge of the coin A transferred on the base plate 2 through the coin feeding arm 9. Thus, the coin A is forced onto the base plate 2 by means of the coin feeding arm 9 and the feeding wing or finger 12.

An outlet port 10 is opened on the lower portion of the peripheral surface of the hollow cylindrical case 3 at one side thereof. An outlet guiding member 11 is protruded from the base plate 2 at the downstream of the outlet port 10 along the travel direction of the coin feeding disc 4. The coin transferred onto the base plate 2 by the coin feeding arm 9 is pushed to the outlet guiding member 11, thereby the travel direction of the coin is forced to deviate towards the outlet port 10. In other words, the coin A transferred on the base plate 2 contacts outlet guiding member 11 located at the downstream side of an outlet port 10, whereby the travel direction of the coin A is forced to deviate towards the output port 10.

On the base plate 2, the scraper 13 is disposed beside the coin feeding disc 4 at the side close to the outlet port 10 of the hollow cylindrical case 3. The scraper comprises feeding wings or fingers 12 extending outwardly radially therefrom. The feeding wings 12 or fingers are equal in number to the coin receiving holes 8 of the coin feeding disc 4. The scraper 13 is disposed such that a tip portion of each feeding wing 12 or fingers is caused to travel through the opening 10*a* and continued from the outlet port 10 beneath the back surface of the coin feeding disc 4 in the hollow cylindrical case 3 and projected to a position between the adjacent coin receiving holes 8, 8.

The scraper 13 is properly secured to a scraper rotary shaft 14 at the center thereof. The scraper rotary shaft 14 is rotated in synchronism with the rotary shaft 7 of the coin feeding disc 4 by the drive motor 5 through the transmission 6. The relative positions of the coin feeding arm 9 and the feeding wing or finger 12 are determined such that, each coin feeding arm 9 of the coin feeding disc 4 and each feeding wing 12 of the scraper 13 are synchronously rotated at the outlet port 10 of the hollow cylindrical case 3 in corporation with each other to push the coin towards the outlet guiding member 11.

Figure 2:
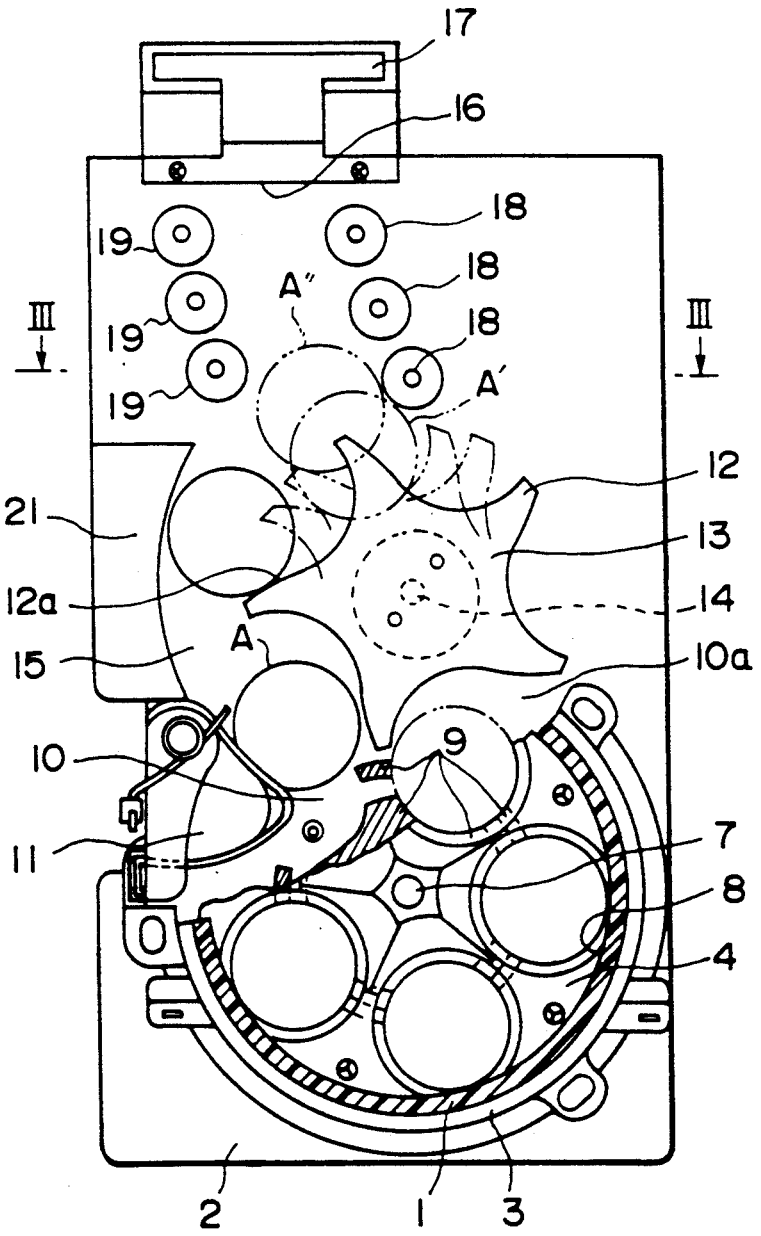
FIG. 2 is a schematical plan view of the coin sorting device illustrated in FIG. 1 except for a hopper.

As described above, the coin A is transferred on the base plate 2 towards the outlet port 10 by means of the feeding wing or finger 12 of the scraper 13. Further, the coin is transferred along a coin transporting path 15 by means of the feeding wing or finger 12 of the rotating scraper 13. The coin transporting path 15 has a configuration of approximately circular arc formed about a rotary shaft 14 of the scraper 13. The coin A is then pushed to guide rollers 18 and 19 as illustrated in FIG. 2.

Once the coin is pushed to and in contact with the guide rollers 18 and 19, the coin is not further transported along the coin transporting path 15 in the circumferential direction of the scraper 13. Thus, the coin A pushed to the guide rollers 18 and 19 is transferred towards a lower end port 16 of a coin carrier duct 17 standing in approximately vertical or upright state. More particularly, the coin A is delivered due to a convex portion of the feeding wing or finger 12 of the scraper 13. The convex portion 12*a* is formed on the leading side to the rotational direction. The coin is fed to the coin carrier duct 17 one by one and is thrown out of an upper outlet port (not shown).

On the base plate 2, a guide 21 is disposed to guide a coin along the coin transporting path 15 of approximately circular arc about the rotary shaft 14 by means of feeding wing or finger 12 of the scraper 13.

As mentioned above, any guide roller, such as a rubber roller, may be disposed at the end of the coin transporting path 15 similar to guide rollers 18 and 19. The guide rollers 18 and 19 serve to interrupt the travel of the coin transferred while being interposed between the feeding wings or fingers 12 of the scraper 13 in the circumferential direction of the scraper. As a result, the travel direction of the coin is forced to deviate or change course.

The well-known coin carrier duct 17 (which in general is referred to as an escalator) is uprightly secured at the extended portion of the coin transporting path 15.

The coin carrier duct 17 comprises a lower end port 16. The coin is transferred towards the lower end port 16 of the coin carrier duct 17 by means of the guide rollers 18 and 19 and the convex portion 12*a* of the feeding wing or finger 12 of the scraper 13.

Figure 3:
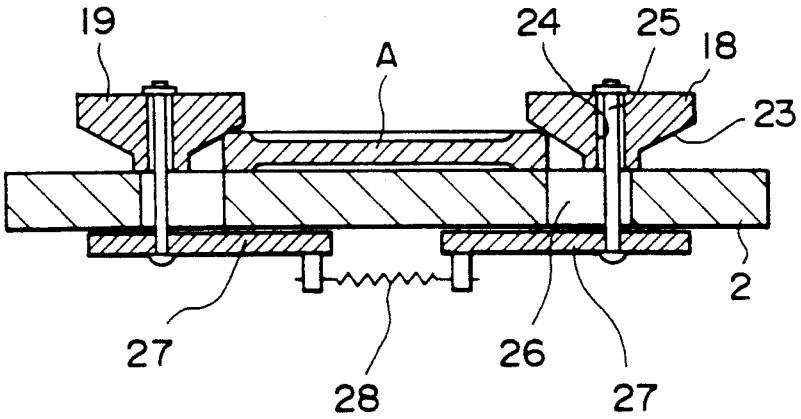
FIG. 3 is a cross sectional view taken on the line III—III in FIG. 2.

As shown in FIG. 2, guide rollers 18 and 19 are disposed with the coin guide 21 in order to guide the coin. One of the exemplified guide rollers 18 and 19 are shown in FIG. 3. In the embodiment illustrated in FIG. 3, the guide rollers 18 and 19 are formed with taper rollers. Each of the taper rollers has a downward taper surface 23. A central shaft 25 passes through a central hole 24 of the taper roller and also passes through a guide hole 26 penetrating through the base plate 2. To the end of the central shaft 25, a slide shoe 27 is attached, whereby the tapered roller is caused to move in the transverse direction of the coin transporting path 15. The spring force is exerted to draw the slide shoes 27 of the pair of tapered rollers toward each other by means of coil spring 28. The coin is interposed between tapered rollers 18 and 19 against the force of the spring. As a result, the coin is forced to the base plate 2 with the aid of the downward tapered surfaces 23 to prevent the coin from rising.

The guide rollers 18 and 19 having the above mentioned construction make it possible to smoothly feed coins along a curved path required for forcing the travel direction of the coin to the coin carrier vertically standing from the inclined base plate 2. With the construction according to the present invention, it is possible to feed coins even in a vertical coin sorting device with the minimum radius of curvature of the curved path for the coin.

Further, according to the present invention, it is possible to reduce the width and depth of the coin sorting device with the escalator having the coin carrier duct vertically extending from the device as compared with the conventional one. As a result, it becomes possible to provide, for example, a vertical coin exchanger having remarkably small width and depth.

While particular embodiments of the present invention have been illustrated and described above, it will be readily understood by those skilled in the art that the present invention can be varied and modified without departing from the scope and spirit of the appended claims.

What is claimed is:

1. A coin sorting device comprising:

a base plate having an upper end portion at which a coin carrier duct is substantially vertically arranged for delivering a coin in the upward direction;

scraper means for feeding the coin towards said upper end portion, said scraper means comprising a rotational body rotatably supported on said base plate and having coin feeding fingers extending radially outwardly from said rotational body, each of said coin feeding fingers being adapted for use in forcing said coin to said upper end portion by means of said rotational body, each of said fingers having a convex portion disposed towards the rotational direction of said rotational body, which convex portion engages said coin while said coin is being forced from said coin feeding finger to said upper end portion; and coin guiding means arranged at said upper end portion for guiding said coin forced to said upper end portion by said coin feeding fingers to said coin carrier duct.

2. A coin sorting device as claimed in claim 1, further comprising:

a rotary disc disposed on said base plate at a distance corresponding to the thickness of the coin;

a guide hole opened on said rotary disc for guiding the coin onto said base plate; and a feeding arm positioned between said base plate and said rotary disc for feeding the coin in said guide hole towards said scraper means, said scraper means being adapted to receive the coin from said feeding arm.

3. A coin sorting device as claimed in claim 1, wherein said coin guiding means is disposed at said upper end portion and comprises a pair of opposed spaced shaft portions disposed at a distance from each other substantially corresponding to a diameter of a coin, and roller means rotatably disposed on each of said pair of shaft portions, said roller means being adapted to prevent the coin from rising.

4. A coin sorting device as claimed in claim 3, wherein each of said roller means has a tapered surface for forcing said coin passing between said roller means against said base plate.

5. A coin sorting device as claimed in claim 3, wherein said pair of shaft portions are disposed at said upper end portion with the distance therebetween being variable.

* * * * *